US010812890B2

(12) United States Patent
Miller et al.

(10) Patent No.: US 10,812,890 B2
(45) **Date of Patent: *Oct. 20, 2020**

(54) CARTILAGE CONDUCTION AUDIO SYSTEM FOR EYEWEAR DEVICES

(71) Applicant: Facebook Technologies, LLC, Menlo Park, CA (US)

(72) Inventors: Antonio John Miller, Woodinville, WA (US); Ravish Mehra, Redmond, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 33 days.

This patent is subject to a terminal disclaimer.

(21) Appl. No.: 16/260,594

(22) Filed: Jan. 29, 2019

(65) Prior Publication Data

US 2019/0158948 A1 May 23, 2019

Related U.S. Application Data

(63) Continuation of application No. 15/680,836, filed on Aug. 18, 2017, now Pat. No. 10,231,046.

(51) Int. Cl.
*H04R 29/00* (2006.01)
*H04R 1/10* (2006.01)
(Continued)

(52) U.S. Cl.
CPC ..... *H04R 1/1041* (2013.01); *H04R 1/028* (2013.01); *H04R 1/1008* (2013.01); *H04R 29/00* (2013.01);
(Continued)

(58) Field of Classification Search
CPC ..... H04R 1/028; H04R 1/1008; H04R 3/04; H04R 25/30; H04R 29/00; H04R 29/001; H04R 29/002; H04R 29/003
(Continued)

(56) References Cited

U.S. PATENT DOCUMENTS 9,288,591 B1 3/2016 Dong et al.
9,722,562 B1 8/2017 Seguin
(Continued)

FOREIGN PATENT DOCUMENTS

EP 3125573 A1 2/2017
EP 3160163 A1 4/2017
KR 10-1463986 B1 12/2014

OTHER PUBLICATIONS

European Patent Office, Extended European Search Report, European Application No. 18189104.5, dated Dec. 21, 2018, 9 pages.
(Continued)

*Primary Examiner* — Katherine A Faley
(74) *Attorney, Agent, or Firm* — Fenwick & West LLP

(57) ABSTRACT

An audio system includes a transducer assembly, an audio sensor, and a controller. The transducer assembly is coupled to a back of an auricle of an ear of the user. The transducer assembly vibrates the auricle over a frequency range to cause the auricle to create an acoustic pressure wave in accordance with vibration instructions. The acoustic sensor detects the acoustic pressure wave at an entrance of the ear of the user. The controller dynamically adjusts a frequency response model based in part on the detected acoustic pressure wave, updates the vibration instructions using the adjusted frequency response model, and provides the updated vibration instructions to the transducer assembly.

20 Claims, 6 Drawing Sheets

(51) Int. Cl.

| | |
|---|---|
| ***H04R 1/02*** | (2006.01) |
| *H04R 3/04* | (2006.01) |
| *H04R 17/00* | (2006.01) |
| *H04S 7/00* | (2006.01) |

(52) U.S. Cl.
CPC ..... *H04R 3/04* (2013.01); *H04R 17/00* (2013.01); *H04R 2460/13* (2013.01); *H04S 7/304* (2013.01); *H04S 2400/11* (2013.01); *H04S 2400/15* (2013.01)

(58) Field of Classification Search
USPC ..... 381/56, 59–60
See application file for complete search history.

(56) References Cited

U.S. PATENT DOCUMENTS

| | | | | |
|---|---|---|---|---|
| 10,356,231 | B2 | 7/2019 | Hosoi et al. | |
| 2011/0301729 | A1 | 12/2011 | Heiman et al. | |
| 2012/0288124 | A1 | 11/2012 | Fejzo et al. | |
| 2013/0216052 | A1 | 8/2013 | Bruss et al. | |
| 2013/0342806 | A1 | 12/2013 | Sathe et al. | |
| 2013/0343562 | A1 | 12/2013 | Amsalem | |
| 2015/0016638 | A1 | 1/2015 | Hebenstreit et al. | |
| 2015/0268673 | A1 | 9/2015 | Farzbod et al. | |
| 2015/0271590 | A1 | 9/2015 | Nakagawa et al. | |
| 2016/0080849 | A1* | 3/2016 | Ikeda ..... | H04R 1/105 381/380 |
| 2016/0127829 | A1 | 5/2016 | Ring et al. | |
| 2016/0329041 | A1 | 11/2016 | Qi et al. | |
| 2017/0078788 | A1 | 3/2017 | Meyer et al. | |

OTHER PUBLICATIONS

PCT International Search Report and Written Opinion, PCT Application No. PCT/US2018/046046, dated Dec. 4, 2018, 14 pages.

* cited by examiner

Eyewear Device 100

CARTILAGE CONDUCTION AUDIO SYSTEM FOR EYEWEAR DEVICES

CROSS REFERENCE TO RELATED APPLICATION

This application is a continuation of co-pending U.S. application Ser. No. 15/680,836, filed Aug. 18, 2017, which is incorporated by reference in its entirety.

BACKGROUND

This disclosure relates generally to an audio system in an eyewear device, and specifically relates to a cartilage conduction audio system for use in eyewear devices.

Head-mounted displays in virtual reality (VR), augmented reality (AR), and/or mixed reality (MR) systems often include features such as speakers or personal audio devices to provide sound to users. These speakers or personal audio devices are typically formed over the ear and cover the ear (e.g., headphones), or placed in the ear (e.g., in-ear headphones or earbuds). However, a user wearing a head-mounted display in a VR, AR, and MR system can benefit from keeping the ear canal open and not covered by an audio devices. For example, the user can have a more immersive and safer experience and receive spatial cues from ambient sound when the ear is unobstructed. It is desirable for an audio system of the eyewear device to be lightweight, ergonomic, low in power consumption, and to not produce crosstalk between the ears. Such features are challenging to incorporate in a full frequency (20 Hz to 20,000 Hz) audio reproduction system on an eyewear device while leaving the ear canal open to the acoustic scene around the user.

SUMMARY

An audio system includes a transducer assembly, an acoustic sensor, and a controller. The transducer assembly is located behind the ear so that an ear canal of the user is clear. The transducer assembly is coupled to a back of an auricle of the user to vibrate the auricle over a frequency range, creating an acoustic pressure wave in accordance with vibration instructions. The auricle of the ear of the user is used as a speaker, keeping the ear canal open such that the ear is open to the acoustic scene around the user. The acoustic sensor detects the acoustic pressure wave at an entrance of the ear of the user. The controller adjusts a frequency response model based in part on the detected acoustic pressure wave, updates the vibration instructions using the adjusted frequency response model, and provides the updated vibration instructions to the transducer assembly. Accordingly, an audio response is individualized for each user based on the detected signal to equalize the audio response per individual. The audio system can be integrated into an eyewear device (e.g., glasses-type headset, near eye display, prescription glasses) and be located behind the ear of the user.

The transducer assembly may include one or more transducers to generate vibrations over a range of frequencies. For example, the transducer assembly includes a piezoelectric transducer to generate vibrations over a first portion of a frequency range and a moving coil transducer to generate vibrations over a second portion of the frequency range.

The acoustic sensor may be a microphone positioned at the entrance of the ear canal to sense the acoustic pressure wave. Alternatively, the acoustic sensor may be a vibration sensor coupled to the auricle of the ear of the user to sense a vibration of the auricle corresponding to the acoustic pressure wave at the entrance of the ear of the user. The vibration sensor may be a piezoelectric sensor or an accelerometer.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Disclosed is a cartilage conduction audio system (audio system) that uses cartilage conduction for providing sound to an ear of a user while keeping the ear canal of the user unobstructed. The audio system includes a transducer coupled to a back of the ear of the user. The transducer generates sound by vibrating the back of the ear (e.g., auricle, or may also be referred to as a pinna) of the user, which vibrates the cartilage in the ear of the user to generate acoustic waves corresponding to received audio content. Advantages of an audio system that uses cartilage conduction over one that only uses bone conduction (e.g., vibration of bones of the skull) include, e.g., reducing crosstalk between the ears, reducing size and power consumption of the audio system, and improving ergonomics. An audio system that uses cartilage conduction uses less coupling force (e.g., less static constant force on the skin) for producing a similar hearing sensation in comparison to an audio system that uses bone conduction, resulting in improved comfort for a wearable device, which is particularly desirable for a wearable device that is worn all day.

System Architecture

Figure 1:
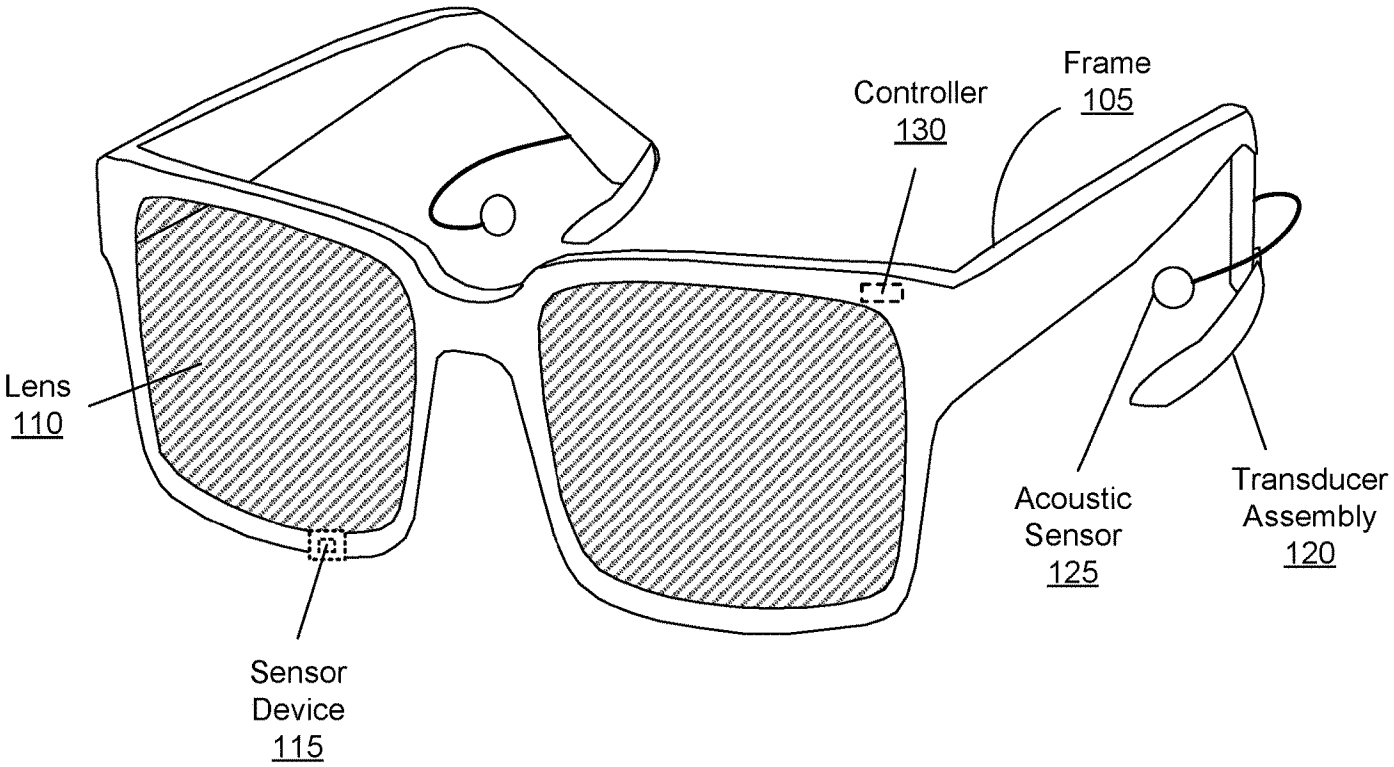
FIG. 1 is an example illustrating an eyewear device including a cartilage conduction audio system (audio system), in accordance with an embodiment.

FIG. 1 is an example illustrating an eyewear device 100 including a cartilage conduction audio system (audio system), in accordance with an embodiment. The eyewear device 100 presents media to a user. In one embodiment, the eyewear device 100 may be a head mounted display (HMD). Examples of media presented by the eyewear device 100 include one or more images, video, audio, or some combination thereof. The eyewear device 100 may include, among other components, a frame 105, a lens 110, a transducer assembly 120, an acoustic sensor 125, and a controller 130.

In some embodiments, the eyewear device 100 may also optionally include a sensor device 115.

The eyewear device 100 may correct or enhance the vision of a user, protect the eye of a user, or provide images to a user. The eyewear device 100 may be eyeglasses which correct for defects in a user's eyesight. The eyewear device 100 may be sunglasses which protect a user's eye from the sun. The eyewear device 100 may be safety glasses which protect a user's eye from impact. The eyewear device 100 may be a night vision device or infrared goggles to enhance a user's vision at night. The eyewear device 100 may be a head mounted display that produces VR, AR, or MR content for the user. Alternatively, the eyewear device 100 may not include a lens 110 and may be a frame 105 with an audio system that provides audio (e.g., music, radio, podcasts) to a user.

The frame 105 includes a front part that holds the lens 110 and end pieces to attach to the user. The front part of the frame 105 bridges the top of a nose of the user. The end pieces (e.g., temples) are portions of the frame 105 to which the temples of a user are attached. The length of the end piece may be adjustable (e.g., adjustable temple length) to fit different users. The end piece may also include a portion that curls behind the ear of the user (e.g., temple tip, ear piece).

The lens 110 provides or transmits light to a user wearing the eyewear device 100. The lens 110 may be prescription lens (e.g., single vision, bifocal and trifocal, or progressive) to help correct for defects in a user's eyesight. The prescription lens transmits ambient light to the user wearing the eyewear device 100. The transmitted ambient light may be altered by the prescription lens to correct for defects in the user's eyesight. The lens 110 may be a polarized lens or a tinted lens to protect the user's eyes from the sun. The lens 110 may be one or more waveguides as part of a waveguide display in which image light is coupled through an end or edge of the waveguide to the eye of the user. The lens 110 may include an electronic display for providing image light and may also include an optics block for magnifying image light from the electronic display. Additional detail regarding the lens 110 can be found in the detailed description of FIG. 5. The lens 110 is held by a front part of the frame 105 of the eyewear device 100.

The sensor device 115 estimates a current position of the eyewear device 100 relative to an initial position of the eyewear device 100. The sensor device 115 may be located on a portion of the frame 105 of the eyewear device 100. The sensor device 115 includes a position sensor and an inertial measurement unit Additional details about the sensor device 115 can be found in the detailed description of FIG. 5.

The audio system of the eyewear device 100 includes the transducer assembly 120, the acoustic sensor 125, and the controller 130. The audio system provides audio content to a user by vibrating the auricle of the ear of the user to produce an acoustic pressure wave. The audio system also uses feedback to create a similar audio experience across different users. Additional detail regarding the audio system can be found in the detailed description of FIG. 3.

The transducer assembly 120 produces sound by vibrating the cartilage in the ear of the user. The transducer assembly 120 is coupled to an end piece of the frame 105 and is configured to be coupled to the back of an auricle of the ear of the user. The auricle is a portion of the outer ear that projects out of a head of the user. The transducer assembly 120 receives vibration instructions from the controller 130. Vibration instructions may include a content signal, a control signal, and a gain signal. The content signal may be based on audio content for presentation to the user. The control signal may be used to enable or disable the transducer assembly 120 or one or more transducers of the transducer assembly. The gain may be used to amplify the content signal. The transducer assembly 120 may include one or more transducer to cover different parts of a frequency range. For example, a piezoelectric transducer may be used to cover a first part of a frequency range and a moving coil transducer may be used to cover a second part of a frequency range. Additional detail regarding the transducer assembly 120 can be found in the detailed description of FIG. 3.

The acoustic sensor 125 detects an acoustic pressure wave at an entrance of an ear of a user. The acoustic sensor 125 is coupled to an end piece of the frame 105. The acoustic sensor 125 as shown in FIG. 1 is a microphone which may be positioned at the entrance of the user's ear. In this embodiment, the microphone may directly measure the acoustic pressure wave at the entrance of the ear of the user. Alternatively, the acoustic sensor 125 is a vibration sensor that is configured to be coupled to the back of the pinna of the user. The vibration sensor may indirectly measure the acoustic pressure wave at the entrance of the ear. For example, the vibration sensor may measure a vibration that is a reflection of the acoustic pressure wave at the entrance of the ear and/or measure a vibration created by the transducer assembly on the auricle of the ear of the user which may be used to estimate the acoustic pressure wave at the entrance of the ear. In one embodiment, a mapping between acoustic pressure generated at the entrance to the ear canal and a vibration level generated on the pinna is an experimentally determined quantity that is measured on a representative sample of users and stored. This stored mapping between the acoustic pressure and vibration level (e.g., frequency dependent linear mapping) of the pinna is applied to a measured vibration signal from the vibration sensor which serves as a proxy for the acoustic pressure at the entrance of the ear canal. The vibration sensor can be an accelerometer or a piezoelectric sensor. An accelerometer may be a piezoelectric accelerometer or a capacitive accelerometer. The capacitive accelerometer senses change in capacitance between structures which can be moved by an accelerative force. In some embodiments, the acoustic sensor 125 is removed from the eyewear device 100 after calibration. Additional detail regarding the acoustic sensor 125 can be found in the detailed description of FIG. 3.

The controller 130 provides vibration instructions to the transducer assembly 120, receives information from the acoustic sensor 125 regarding the produced sound, and updates the vibration instructions based on the received information. Vibration instructions instruct the transducer assembly 120 how to produce vibrations. For example, vibration instructions may include a content signal (e.g., electrical signal applied to the transducer assembly 120 to produce a vibration), a control signal to enable or disable the transducer assembly 120, and a gain signal to scale the content signal (e.g., increase or decrease the vibrations produced by the transducer assembly 120). The vibration instructions may be generated by the controller 130. The controller 130 may receive audio content (e.g., music, calibration signal) from a console for presentation to a user and generate vibration instructions based on the received audio content. The controller 130 receives information from the acoustic sensor 125 that describes the produced sound at an ear of the user. In one embodiment the acoustic sensor 125 is a vibration sensor that measures a vibration of a pinna of a user and the controller 130 applies a previously stored frequency dependent linear mapping of pressure to vibration to determine the acoustic pressure wave at the entrance of the ear based on the received detected vibration. The controller 130 uses the received information as feedback to compare the produced sound to a target sound (e.g., audio content) and adjusts the vibration instructions to make the produced sound closer to the target sound. The controller 130 is embedded into the frame 105 of the eyewear device 100. In other embodiments, the controller 130 may be located in a different location. For example, the controller 130 may be part of the transducer assembly or located external to the eyewear device 100. Additional detail regarding the controller 130 can be found in the detailed description of FIG. 3.

Figure 2A:
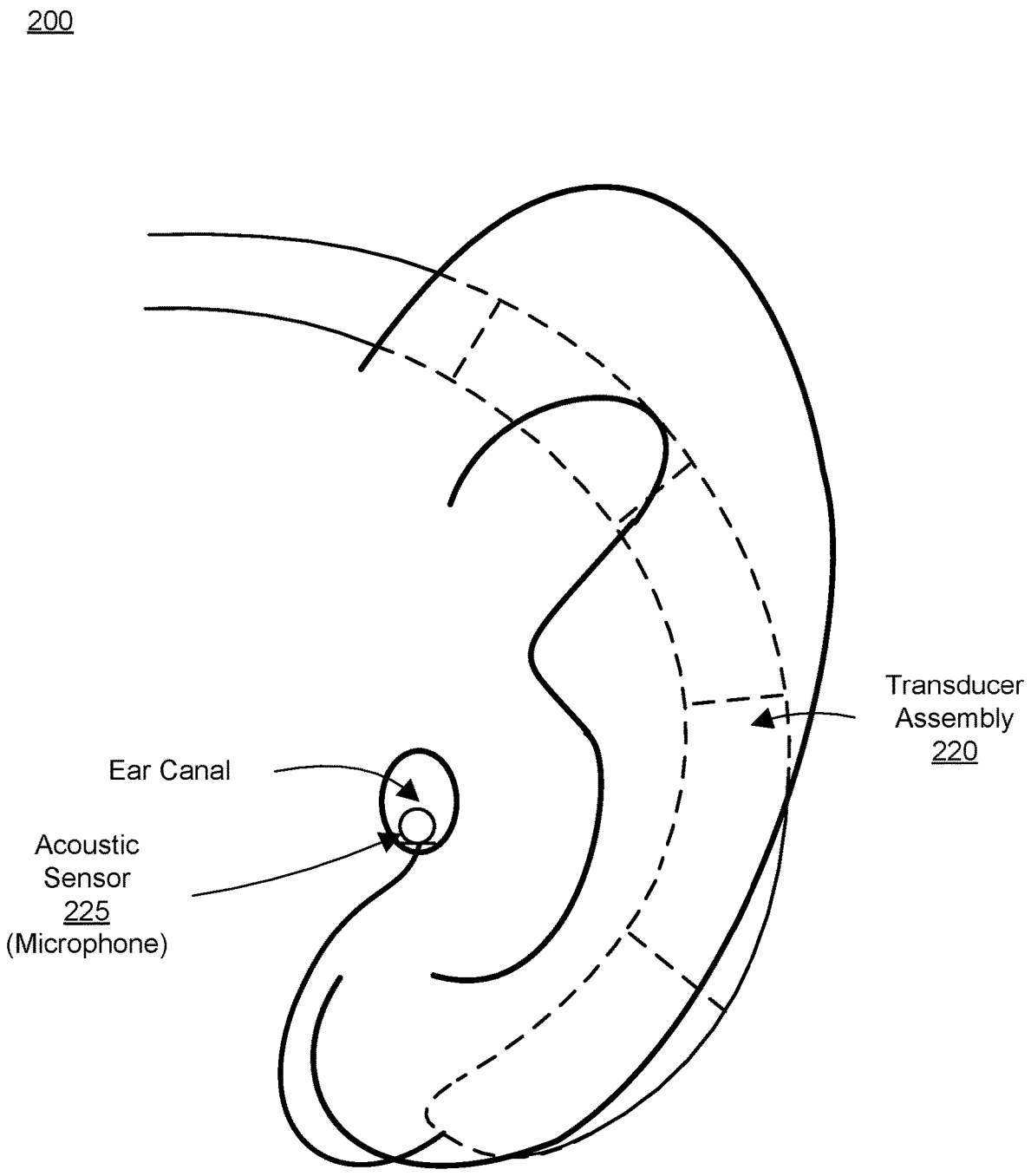
FIG. 2A is an example illustrating a portion of an eyewear device including a transducer assembly and an acoustic sensor that is a microphone on an ear of a user, in accordance with an embodiment.

FIG. 2A is an example illustrating a portion of the eyewear device 200 including a transducer assembly 220 that is a microphone and acoustic sensor 225 on an ear of the user, in accordance with an embodiment. The eyewear device 200, transducer assembly 220, and acoustic sensor 225 are embodiments of the eyewear device 100, transducer assembly 120, and the acoustic sensor 125. The transducer assembly 220 is coupled to a back of an ear of a user. The transducer assembly vibrates the back of the ear of a user to generate a pressure wave based on vibration instructions. The acoustic sensor 225 is a microphone positioned at an entrance of the ear of the user to detect the pressure wave produced by the transducer assembly 220. The audio system compares the detected pressure wave (e.g. produced sound) with a target pressure wave (e.g. audio content) and adjusts vibration instructions to make a detected pressure wave more similar to a target pressure wave.

Figure 2B:
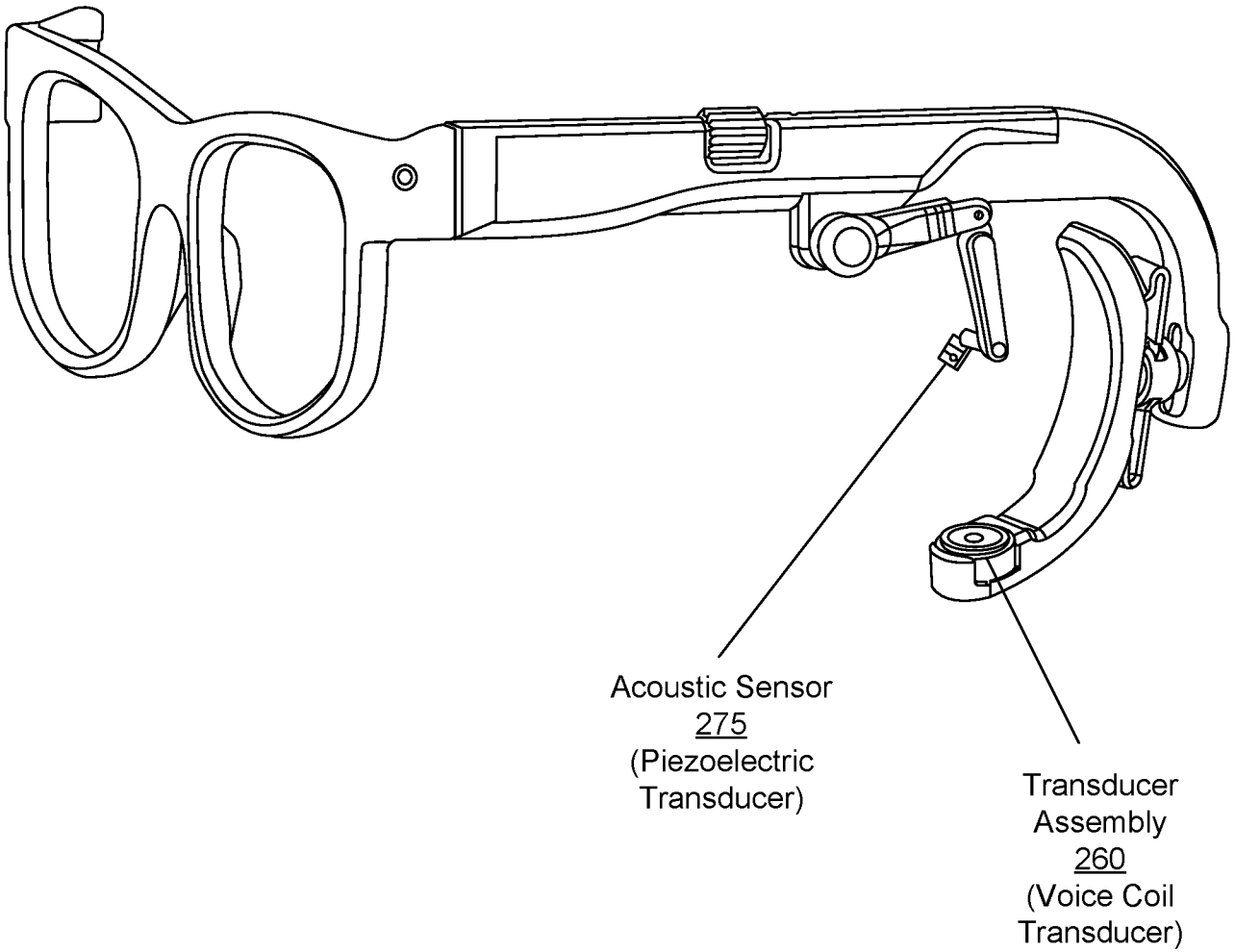
FIG. 2B is an example illustrating a portion of the eyewear device 250 including a transducer assembly and acoustic sensor that is a piezoelectric transducer, in accordance with an embodiment.

FIG. 2B is an example illustrating a portion of the eyewear device 250 including a transducer assembly 260 and acoustic sensor 275 that is a piezoelectric transducer, in accordance with an embodiment. The eyewear device 250, transducer assembly 260, and acoustic sensor 275 are embodiments of the eyewear device 100, transducer assembly 120, and the acoustic sensor 125. The transducer assembly 260 is a transducer located around the end piece of the frame (e.g., bottom of a behind-the-ear ear cup) that is to be coupled to the back of the ear of a user. In this embodiment, the transducer assembly 260 is shown to be a circular voice coil (e.g., moving coil) transducer. The acoustic sensor 275 is a piezoelectric transducer that is to be coupled to the back of the ear of a user. The piezoelectric transducer may be a stacked piezoelectric transducer and may have a dimension in the range of a few millimeters in size (e.g., 9 mm).

Figure 3:
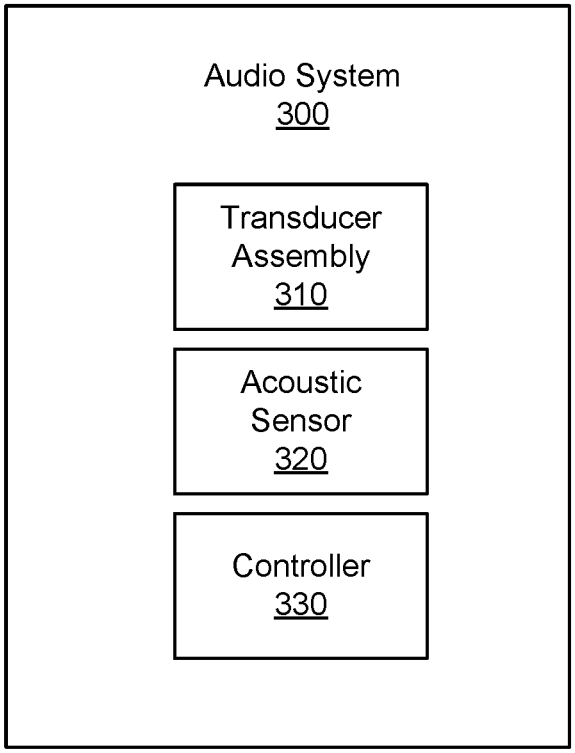
FIG. 3 is a block diagram of an audio system, in accordance with an embodiment.

FIG. 3 is a block diagram of an audio system 300, in accordance with an embodiment. The audio system in FIG. 1 is an embodiment of the audio system 300. The audio system 300 includes a transducer assembly 310, an acoustic sensor 320, and a controller 330.

The transducer assembly 310 vibrates a cartilage of a user's ear in accordance with the vibration instructions (e.g., received from the controller 330). The transducer assembly 310 is coupled to a first portion of a back of an auricle of an ear of a user. The transducer assembly 310 includes at least one transducer to vibrate the auricle over a frequency range to cause the auricle to create an acoustic pressure wave in accordance with vibration instructions. The transducer may be a single piezoelectric transducer. A piezoelectric transducer can generate frequencies up to 20 kHz using a range of voltages around +/−100V. The range of voltages may include lower voltages as well (e.g., +/−10V). The piezoelectric transducer may be a stacked piezoelectric actuator. The stacked piezoelectric actuator includes multiple piezoelectric elements that are stacked (e.g. mechanically connected in series). The stacked piezoelectric actuator may have a lower range of voltages because the movement of a stacked piezoelectric actuator can be a product of the movement of a single piezoelectric element with the number of elements in the stack. A piezoelectric transducer is made of a piezoelectric material that can generate a strain (e.g., deformation in the material) in the presence of an electric field. The piezoelectric material may be a polymer (e.g., polyvinyl chloride (PVC), polyvinylidene fluoroide (PVDF)), a polymer-based composite, ceramic, or crystal (e.g., quartz (silicon dioxide or $SiO_2$), lead zirconate-titanate (PZT)). By applying an electric field or a voltage across a polymer which is a polarized material, the polymer changes in polarization and may compress or expand depending on the polarity and magnitude of the applied electric field. The piezoelectric transducer may be coupled to a material (e.g., silicone) that attaches well to the back of an ear of a user. In one embodiment, the transducer assembly 310 maintains good surface contact with the back of the user's ear and maintains a steady amount of application force (e.g., 1 Newton) to the user's ear.

In some embodiments, the transducer assembly 310 is configured to generation vibrations over a range of frequencies and includes a first transducer and a second transducer. The first transducer is configured to provide a first portion of the frequency range (e.g., higher range up to 20 kHz). The first transducer may be, e.g., a piezoelectric transducer. The second transducer is configured to provide a second portion of the frequency range (e.g., lower range around 20 Hz). The second transducer may be a piezoelectric transducer or may be a different type of transducer such as a moving coil transducer. A typical moving coil transducer includes a coil of wire and a permanent magnet to produce a permanent magnetic field. Applying a current to the wire while it is placed in the permanent magnetic field produces a force on the coil based on the amplitude and the polarity of the current that can move the coil towards or away from the permanent magnet. The second transducer may be made of a more rigid material than the first transducer. The second transducer may be coupled to a second portion different than the first portion of the back of the ear of the user. Alternatively, the second transducer may be in contact with the skull of the user.

The acoustic sensor 320 provides information regarding the produced sound to the controller 330. The acoustic sensor 320 detects an acoustic pressure wave at an entrance of an ear of a user. In one embodiment, the acoustic sensor 320 is a microphone positioned at an entrance of an ear of a user. A microphone is a transducer that converts pressure into an electrical signal. The frequency response of the microphone may be relatively flat in some portions of a frequency range and may be linear in other portions of a frequency range. The microphone may be configured to receive a gain signal to scale a detected signal from the microphone based on the vibration instructions provided to the transducer assembly 310. For example, the gain may be adjusted based on the vibration instructions to avoid clipping of the detected signal or for improving a signal to noise ratio in the detected signal.

In some embodiments the acoustic sensor 320 may be a vibration sensor. The vibration sensor is coupled to a portion of the ear. In some embodiments, the vibration sensor and the transducer assembly 310 couple to different portions of the ear. The vibration sensor is similar to the transducers used in the transducer assembly except the signal is flowing in reverse. Instead of an electrical signal producing a mechanical vibration in a transducer, a mechanical vibration is generating an electrical signal in the vibration sensor. A vibration sensor may be made of piezoelectric material that can generate an electrical signal when the piezoelectric material is deformed. The piezoelectric material may be a polymer (e.g., PVC, PVDF), a polymer-based composite, ceramic, or crystal (e.g., $SiO_2$, PZT). By applying a pressure on the piezoelectric material, the piezoelectric material changes in polarization and produces an electrical signal. The piezoelectric sensor may be coupled to a material (e.g., silicone) that attaches well to the back of an ear of a user. A vibration sensor can also be an accelerometer. The accelerometer may be piezoelectric or capacitive. A capacitive accelerometer measures changes in capacitance between structures which can be moved by an accelerative force. In one embodiment, the vibration sensor maintains good surface contact with the back of the user's ear and maintains a steady amount of application force (e.g., 1 Newton) to the user's ear. The vibration sensor may be an accelerometer. The vibration sensor may be integrated in an internal measurement unit (IMU) integrated circuit (IC). The IMU is further described with relation to FIG. 5.

The controller 330 controls components of the audio system 300. The controller 330 generates vibration instructions to instruct the transducer assembly 310 how to produce vibrations. For example, vibration instructions may include a content signal (e.g., electrical signal applied to the transducer assembly 310 to produce a vibration), a control signal to enable or disable the transducer assembly 310, and a gain signal to scale the content signal (e.g., increase or decrease the vibrations produced by the transducer assembly 310). The controller 330 generates the content signal of the vibration instructions based on audio content and a frequency response model. A frequency response model describes the response of a system to inputs at certain frequencies and may indicate how an output is shifted in amplitude and phase based on the input. Thus, the controller 330 may generate a content signal (e.g., input signal) of the vibration instructions with the audio content (e.g., target output) and the frequency response model (e.g., relationship of the input to the output). In one embodiment, the controller 330 may generate the content signal of the vibration instructions by applying an inverse of the frequency response to the audio content. The controller 330 receives feedback from an acoustic sensor 320. The acoustic sensor 320 provides information about the sound signal (e.g., acoustic pressure wave) produced by the vibration transducer 310. The controller 330 may compare the detected acoustic pressure wave with a target acoustic pressure wave based on audio content provided to the user. The controller 330 can then compute an inverse function to apply to the detected acoustic wave such that the detected acoustic pressure wave appears the same as the target acoustic pressure wave. Thus, the controller 330 can adjust the frequency response model of the audio system using the computed inverse function specific to each user. The adjustment of the frequency model may be performed while the user is listening to audio content. The controller 330 can then generate updated vibration instructions using the adjusted frequency response model. The controller 330 enables a similar audio experience to be produced across different users of the sound system. In a cartilage conduction audio system, the speaker of the audio system corresponds to a user's auricle. As each auricle of a user is different (e.g., shape and size), the frequency response model will vary from user to user. By adjusting the frequency response model for each user based on audio feedback, the audio system can maintain the same type of produced sound (e.g., neutral listening) regardless of the user. Neutral listening is having similar listening experience across different users. In other words, the listening experience is impartial or neutral to the user (e.g., does not change from user to user).

In one embodiment, the audio system uses a flat spectrum broadband signal to generate the adjusted frequency response model. For example, the controller 330 provides vibration instructions to the transducer assembly 310 based on a flat spectrum broadband signal. The acoustic sensor 320 detects an acoustic pressure wave at an entrance of an ear of the user. The controller 330 compares the detected acoustic pressure wave with the target acoustic pressure wave based on the flat spectrum broadband signal and adjusts the frequency model of the audio system accordingly. In this embodiment, the flat spectrum broadband signal may be used while performing calibration of the audio system for a particular user. Thus, the audio system may perform an initial calibration for a user instead of continuously monitoring the audio system. In this embodiment, the acoustic sensor may be temporarily coupled to the eyewear device for calibration of the user. Responsive to completing calibration of the user, the acoustic sensor may be uncoupled to the eyewear device. Advantages of removing the acoustic sensor from the eyewear device include making it easier to wear and reducing the volume and weight of the eyewear device.

Figure 4:
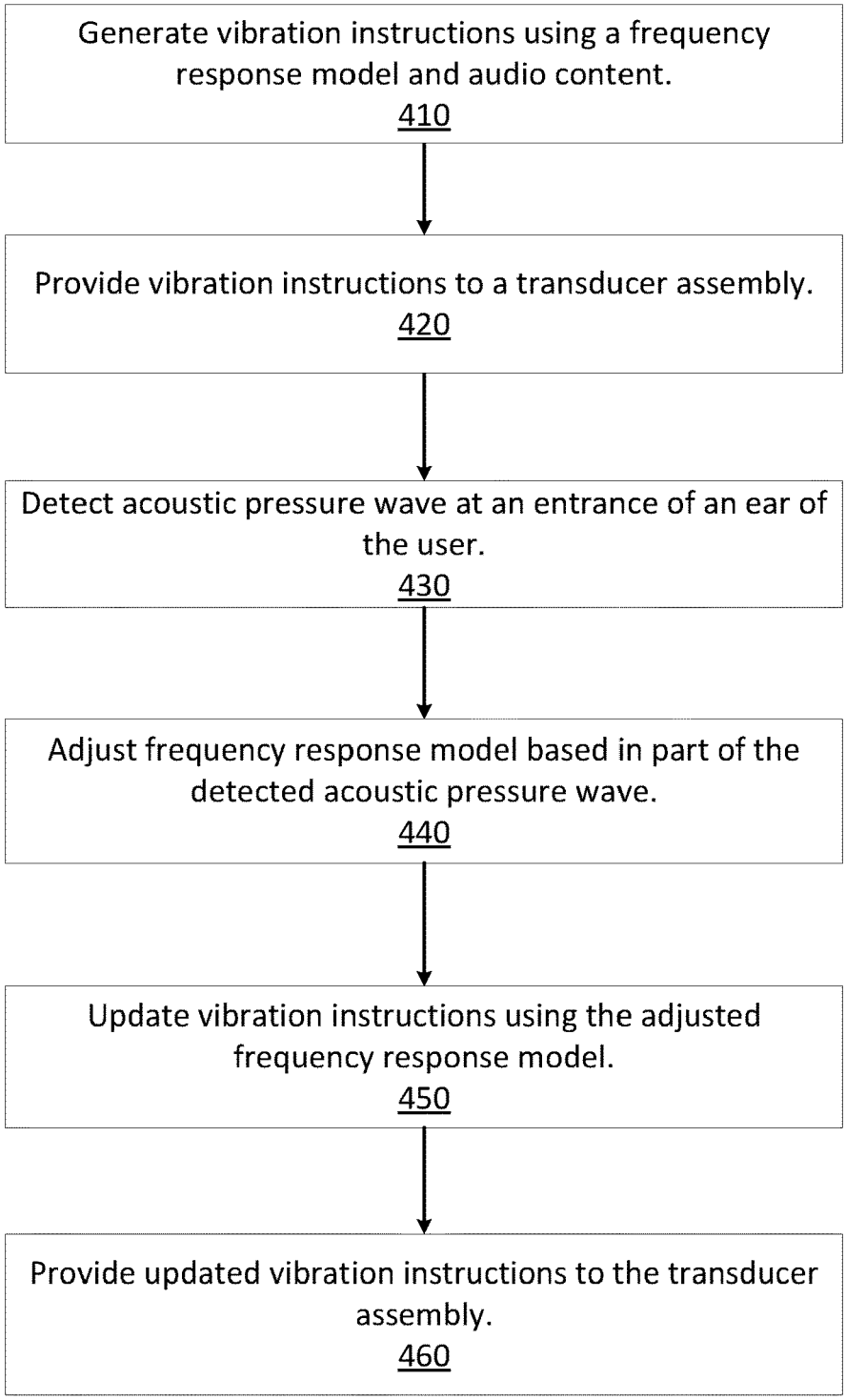
FIG. 4 is a flowchart illustrating a process of operating a cartilage conduction audio system, in accordance with an embodiment.

FIG. 4 is a flowchart illustrating a process of operating an audio system that uses cartilage conduction, in accordance with an embodiment. The process 400 of FIG. 4 may be performed by an audio system that uses cartilage conduction (e.g., the audio system 300). Other entities (e.g., an eyewear device and/or console) may perform some or all of the steps of the process in other embodiments. Likewise, embodiments may include different and/or additional steps, or perform the steps in different orders.

The audio system generates 410 vibration instructions using a frequency response model and audio content. The audio system may receive audio content from a console. The audio content may include content such as music, radio signal, or calibration signal. The frequency response model describes a relationship between an input (e.g., audio content, vibration instructions) and output (e.g., produced audio, sound pressure wave, vibrations) of the auricle of an ear of a user which is used as a speaker in the audio system. A controller (e.g., the controller 330) may generate the vibration instructions using the frequency response model and the audio content. For example, the controller may start with the audio content and use the frequency response model (e.g., apply inverse frequency response) to estimate vibration instructions to produce the audio content.

The audio system provides 420 the vibration instructions to a transducer assembly (e.g., the transducer assembly 310). The transducer assembly is coupled to the back of an auricle of an ear of a user and vibrates the auricle based on the vibration instructions. The vibration of the auricle produces an acoustic pressure wave that provides sound based on the audio content to the user.

The audio system detects 430 acoustic pressure wave at an entrance of an ear of the user. The acoustic pressure wave is generated by the transducer assembly. In one embodiment, an acoustic sensor (e.g., acoustic sensor 320) may be a microphone positioned at the entrance of the ear of the user to detect the acoustic pressure wave at the entrance of the ear of the user.

The audio system adjusts 440 frequency response model based in part of the detected acoustic pressure wave. The controller may compare the detected acoustic pressure wave with a target acoustic pressure wave based on audio content provided to the user. The controller can compute an inverse function to apply to the detected acoustic wave such that the detected acoustic pressure wave appears the same as the target acoustic pressure wave.

The audio system updates 450 vibration instructions using the adjusted frequency response model. The updated vibration instructions may be generated by the controller which uses audio content and the adjusted frequency response model. For example, the controller may start with audio content and use the adjusted frequency response model to estimate updated vibration instructions to produce audio content closer to a target acoustic pressure wave.

The audio system provides 460 updated vibration instructions to the transducer assembly. The transducer assembly vibrates the auricle produces an updated acoustic pressure wave that provides sound based on the updated vibration instructions to the user. The updated acoustic pressure wave may appear closer to a target acoustic pressure wave.

The audio system may dynamically adjust the frequency response model while the user is listening to audio content or may just adjust the frequency response model during a calibration of the audio system per user.

Figure 5:
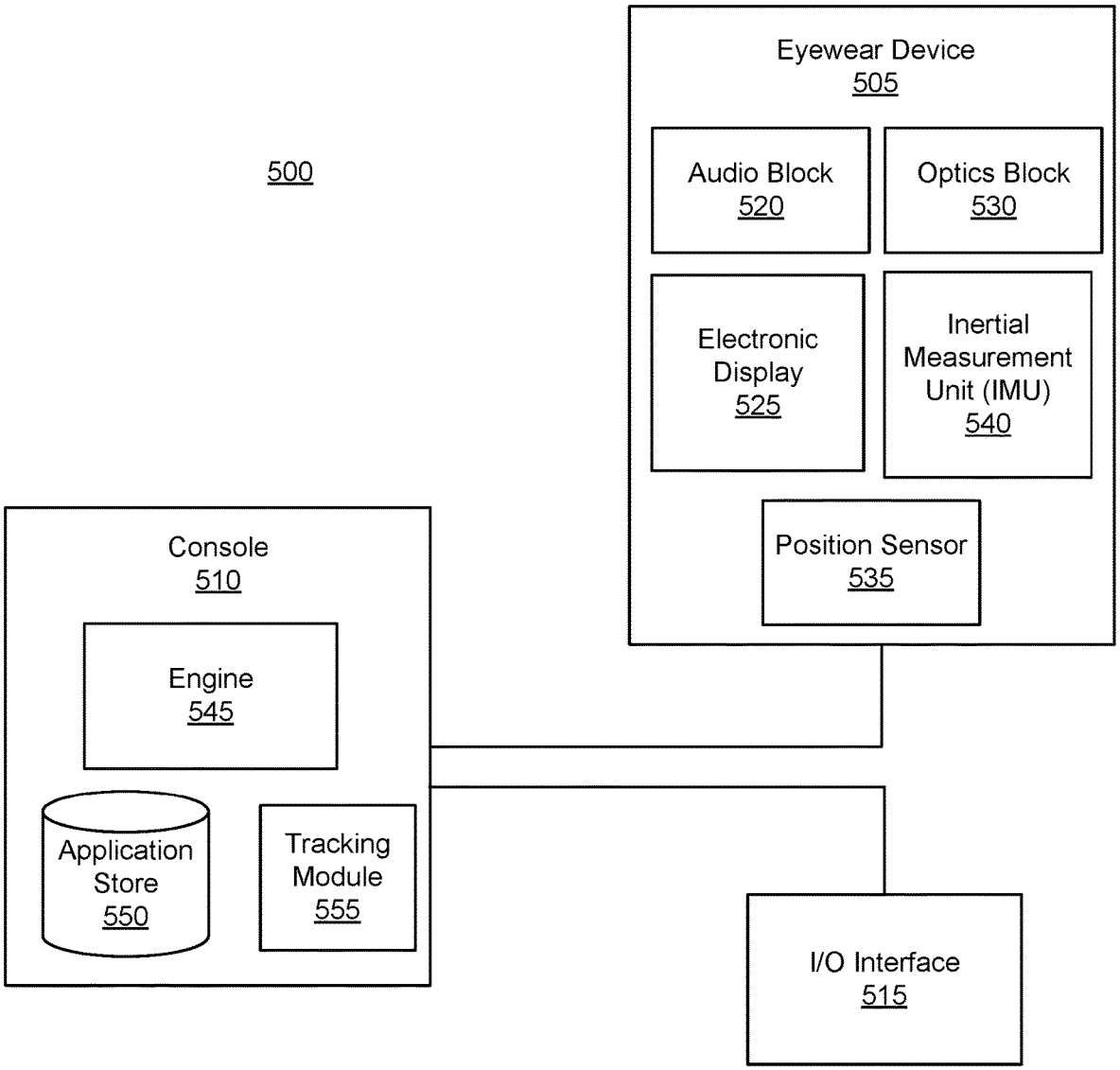
FIG. 5 is a system environment of an eyewear device including a cartilage conduction audio system, in accordance with an embodiment.

FIG. 5 is a system environment 500 of the eyewear device including a cartilage conduction audio system, in accordance with an embodiment. The system 500 may operate in a VR, AR, or MR environment, or some combination thereof. The system 500 shown by FIG. 5 comprises an eyewear device 505 and an input/output (I/O) interface 515 that is coupled to a console 510. The eyewear device 505 may be an embodiment of the eyewear device 100. While FIG. 5 shows an example system 500 including one eyewear device 505 and one I/O interface 515, in other embodiments any number of these components may be included in the system 500. For example, there may be multiple eyewear devices 505 each having an associated I/O interface 515 with each eyewear device 505 and I/O interface 515 communicating with the console 510. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 510 is provided by the eyewear device 505.

The eyewear device 505 may be a head-mounted display that presents content to a user comprising augmented views of a physical, real-world environment with computer-generated elements (e.g., two dimensional (2D) or three dimensional (3D) images, 2D or 3D video, sound, etc.). In some embodiments, the presented content includes audio that is presented via an audio block 520 that receives audio information from the eyewear device 505, the console 510, or both, and presents audio data based on the audio information. The eyewear device 505 may comprise one or more rigid bodies, which may be rigidly or non-rigidly coupled to each other together. A rigid coupling between rigid bodies causes the coupled rigid bodies to act as a single rigid entity. In contrast, a non-rigid coupling between rigid bodies allows the rigid bodies to move relative to each other. In some embodiments, the eyewear device 505 presents virtual content to the user that is based in part on a real environment surrounding the user. For example, virtual content may be presented to a user of the eyewear device. The user physically may be in a room, and virtual walls and a virtual floor of the room are rendered as part of the virtual content.

The eyewear device 505 includes an audio block 520. The audio block 520 is one embodiment of the audio system 300. The audio block 520 is a cartilage conduction audio system which provides audio information to a user by vibrating the cartilage in a user's ear to produce sound. The audio block 520 monitors the produced sound so that it can compensate for a frequency response model for each ear of the user and can maintain the same type of produced sound across different individuals.

The eyewear device 505 may include an electronic display 525, an optics block 530, one or more position sensors 535, and an inertial measurement Unit (IMU) 540. The electronic display 525 and the optics block 530 is one embodiment of a lens 110. The position sensors 535 and the IMU 540 is one embodiment of sensor device 115. Some embodiments of the eyewear device 505 have different components than those described in conjunction with FIG. 5. Additionally, the functionality provided by various components described in conjunction with FIG. 5 may be differently distributed among the components of the eyewear device 505 in other embodiments, or be captured in separate assemblies remote from the eyewear device 505.

The electronic display 525 displays 2D or 3D images to the user in accordance with data received from the console 510. In various embodiments, the electronic display 525 comprises a single electronic display or multiple electronic displays (e.g., a display for each eye of a user). Examples of the electronic display 525 include: a liquid crystal display (LCD), an organic light emitting diode (OLED) display, an active-matrix organic light-emitting diode display (AMOLED), some other display, or some combination thereof.

The optics block 530 magnifies image light received from the electronic display 525, corrects optical errors associated with the image light, and presents the corrected image light to a user of the eyewear device 505. In various embodiments, the optics block 530 includes one or more optical elements. Example optical elements included in the optics block 530 include: an aperture, a Fresnel lens, a convex lens, a concave lens, a filter, a reflecting surface, or any other suitable optical element that affects image light. Moreover, the optics block 530 may include combinations of different optical elements. In some embodiments, one or more of the optical elements in the optics block 530 may have one or more coatings, such as partially reflective or anti-reflective coatings.

Magnification and focusing of the image light by the optics block 530 allows the electronic display 525 to be physically smaller, weigh less, and consume less power than larger displays. Additionally, magnification may increase the field of view of the content presented by the electronic display 525. For example, the field of view of the displayed content is such that the displayed content is presented using almost all (e.g., approximately 110 degrees diagonal), and in some cases all, of the user's field of view. Additionally in some embodiments, the amount of magnification may be adjusted by adding or removing optical elements.

In some embodiments, the optics block 530 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display 525 for display is predistorted, and the optics block 530 corrects the distortion when it receives image light from the electronic display 525 generated based on the content.

The IMU 540 is an electronic device that generates data indicating a position of the eyewear device 505 based on measurement signals received from one or more of the position sensors 535. A position sensor 535 generates one or more measurement signals in response to motion of the eyewear device 505. Examples of position sensors 535 include: one or more accelerometers, one or more gyroscopes, one or more magnetometers, another suitable type of sensor that detects motion, a type of sensor used for error correction of the IMU 540, or some combination thereof. The position sensors 535 may be located external to the IMU 540, internal to the IMU 540, or some combination thereof.

Based on the one or more measurement signals from one or more position sensors 535, the IMU 540 generates data indicating an estimated current position of the eyewear device 505 relative to an initial position of the eyewear device 505. For example, the position sensors 535 include multiple accelerometers to measure translational motion (forward/back, up/down, left/right) and multiple gyroscopes to measure rotational motion (e.g., pitch, yaw, and roll). In some embodiments, the IMU 540 rapidly samples the measurement signals and calculates the estimated current position of the eyewear device 505 from the sampled data. For example, the IMU 540 integrates the measurement signals received from the accelerometers over time to estimate a velocity vector and integrates the velocity vector over time to determine an estimated current position of a reference point on the eyewear device 505. Alternatively, the IMU 540 provides the sampled measurement signals to the console 510, which interprets the data to reduce error. The reference point is a point that may be used to describe the position of the eyewear device 505. The reference point may generally be defined as a point in space or a position related to the eyewear device's 505 orientation and position.

The IMU 540 receives one or more parameters from the console 510. As further discussed below, the one or more parameters are used to maintain tracking of the eyewear device 505. Based on a received parameter, the IMU 540 may adjust one or more IMU parameters (e.g., sample rate). In some embodiments, certain parameters cause the IMU 540 to update an initial position of the reference point so it corresponds to a next position of the reference point. Updating the initial position of the reference point as the next calibrated position of the reference point helps reduce accumulated error associated with the current position estimated the IMU 540. The accumulated error, also referred to as drift error, causes the estimated position of the reference point to "drift" away from the actual position of the reference point over time. In some embodiments of the eyewear device 505, the IMU 540 may be a dedicated hardware component. In other embodiments, the IMU 540 may be a software component implemented in one or more processors.

The I/O interface 515 is a device that allows a user to send action requests and receive responses from the console 510. An action request is a request to perform a particular action. For example, an action request may be an instruction to start or end capture of image or video data, or an instruction to perform a particular action within an application. The I/O interface 515 may include one or more input devices. Example input devices include: a keyboard, a mouse, a game controller, or any other suitable device for receiving action requests and communicating the action requests to the console 510. An action request received by the I/O interface 515 is communicated to the console 510, which performs an action corresponding to the action request. In some embodiments, the I/O interface 515 includes an IMU 540, as further described above, that captures calibration data indicating an estimated position of the I/O interface 515 relative to an initial position of the I/O interface 515. In some embodiments, the I/O interface 515 may provide haptic feedback to the user in accordance with instructions received from the console 510. For example, haptic feedback is provided when an action request is received, or the console 510 communicates instructions to the I/O interface 515 causing the I/O interface 515 to generate haptic feedback when the console 510 performs an action.

The console 510 provides content to the eyewear device 505 for processing in accordance with information received from one or more of: the eyewear device 505 and the I/O interface 515. In the example shown in FIG. 5, the console 510 includes an application store 550, a tracking module 555 and an engine 545. Some embodiments of the console 510 have different modules or components than those described in conjunction with FIG. 5. Similarly, the functions further described below may be distributed among components of the console 510 in a different manner than described in conjunction with FIG. 5.

The application store 550 stores one or more applications for execution by the console 510. An application is a group of instructions, that when executed by a processor, generates content for presentation to the user. Content generated by an application may be in response to inputs received from the user via movement of the eyewear device 505 or the I/O interface 515. Examples of applications include: gaming applications, conferencing applications, video playback applications, or other suitable applications.

The tracking module 555 calibrates the system environment 500 using one or more calibration parameters and may adjust one or more calibration parameters to reduce error in determination of the position of the eyewear device 505 or of the I/O interface 515. Calibration performed by the tracking module 555 also accounts for information received from the IMU 540 in the eyewear device 505 and/or an IMU 540 included in the I/O interface 515. Additionally, if tracking of the eyewear device 505 is lost, the tracking module 555 may re-calibrate some or all of the system environment 500.

The tracking module 555 tracks movements of the eyewear device 505 or of the I/O interface 515 using information from the one or more position sensors 535, the IMU 540 or some combination thereof. For example, the tracking module 555 determines a position of a reference point of the eyewear device 505 in a mapping of a local area based on information from the eyewear device 505. The tracking module 555 may also determine positions of the reference point of the eyewear device 505 or a reference point of the I/O interface 515 using data indicating a position of the eyewear device 505 from the IMU 540 or using data indicating a position of the I/O interface 515 from an IMU 540 included in the I/O interface 515, respectively. Additionally, in some embodiments, the tracking module 555 may use portions of data indicating a position or the eyewear device 505 from the IMU 540 to predict a future location of the eyewear device 505. The tracking module 555 provides the estimated or predicted future position of the eyewear device 505 or the I/O interface 515 to the engine 545.

The engine 545 also executes applications within the system environment 500 and receives position information, acceleration information, velocity information, predicted future positions, or some combination thereof, of the eyewear device 505 from the tracking module 555. Based on the received information, the engine 545 determines content to provide to the eyewear device 505 for presentation to the user. For example, if the received information indicates that the user has looked to the left, the engine 545 generates content for the eyewear device 505 that mirrors the user's movement in a virtual environment or in an environment augmenting the local area with additional content. Additionally, the engine 545 performs an action within an application executing on the console 510 in response to an action request received from the I/O interface 515 and provides feedback to the user that the action was performed. The provided feedback may be visual or audible feedback via the eyewear device 505 or haptic feedback via the I/O interface 515.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. An audio system comprising:

a transducer assembly configured to be coupled to a first portion of an auricle of an ear of a user, the transducer assembly including at least one transducer that is configured to vibrate at least the first portion of the auricle over a frequency range to create an airborne acoustic pressure wave in an ear canal of the user in accordance with vibration instructions, and the airborne acoustic pressure wave corresponds to and is for presentation of audio content to the user;

an acoustic sensor configured to detect the airborne acoustic pressure wave at an entrance of the ear of the user; and a controller configured to:

provide the vibration instructions to the transducer assembly, update the vibration instructions based at least in part on the detected acoustic pressure wave, and provide the updated vibration instructions to the transducer assembly.

2. The audio system of claim 1, wherein the vibration instructions include a content signal based on the audio content for presentation to the user, a control signal to enable or disable the transducer assembly, and a gain signal to amplify the content signal.

3. The audio system of claim 1, wherein the at least one transducer is a stacked piezoelectric actuator comprising multiple piezoelectric elements connected in series.

4. The audio system of claim 1, wherein the transducer assembly is configured to generate vibrations over a range of frequencies, and the transducer assembly includes a first transducer and a second transducer, the first transducer is configured to provide a first portion of the frequency range, and the second transducer is configured to provide a second portion of the frequency range.

5. The audio system of claim 4, wherein the first transducer is a piezoelectric transducer and the second transducer is a moving coil transducer.

6. The audio system of claim 1, wherein the acoustic sensor is a microphone configured to sense the acoustic pressure wave at the entrance of the ear canal.

7. The audio system of claim 1, wherein the acoustic sensor is a vibration sensor configured to sense a vibration of the auricle corresponding to the acoustic pressure wave at the entrance of the ear of the user.

8. The audio system of claim 1, wherein the controller adjusts a frequency response model based in part on the detected airborne acoustic pressure wave by computing an inverse function and applying the inverse function to the detected airborne acoustic pressure wave.

9. The audio system of claim 8, wherein the audio system uses a flat spectrum broadband signal to generate the adjusted frequency response model.

10. The audio system of claim 1, wherein the audio system is part of an eyewear device.

11. A method comprising:

providing, by a controller, vibration instructions to a transducer assembly configured to be coupled to a first portion of an auricle of an ear of a user, the transducer assembly including at least one transducer that is configured to vibrate at least the first portion of the auricle over a frequency range to create an airborne acoustic pressure wave in an ear canal of the user in accordance with the vibration instructions, and the airborne acoustic pressure wave corresponds to and is for presentation of audio content to the user;

receiving, by the controller, information from an acoustic sensor, the received information describing the airborne acoustic pressure wave at an entrance of the ear of the user detected by the acoustic sensor;

updating the vibration instructions, by the controller, based in part on the detected acoustic pressure wave; and providing, by the controller, the updated vibration instructions to the transducer assembly.

12. The method of claim 11, wherein the vibration instructions include a content signal based on the audio content for presentation to the user, a control signal to enable or disable the transducer assembly, and a gain signal to amplify the content signal.

13. The method of claim 11, further comprising:

adjusting, by the controller, a frequency response model based in part on the detected airborne acoustic pressure wave;

updating the vibration instructions, by the controller, using the adjusted frequency response model; and providing, by the controller, the updated vibration instructions to the transducer assembly.

14. The method of claim 13, wherein adjusting the frequency response model further comprises:

computing, by the controller, an inverse function; and applying, by the controller, the inverse function to the detected airborne acoustic pressure wave.

15. The method of claim 13, wherein a flat spectrum broadband signal is used to generate the adjusted frequency response model.

16. A non-transitory computer-readable storage medium storing executable computer program instructions, the instructions executable to perform steps comprising:

providing vibration instructions to a transducer assembly configured to be coupled to a first portion of an auricle of an ear of a user, the transducer assembly including at least one transducer that is configured to vibrate at least the first portion of the auricle over a frequency range to create an airborne acoustic pressure wave in an ear canal of the user in accordance with the vibration instructions, and the airborne acoustic pressure wave corresponds to and is for presentation of audio content to the user;

receiving information from an acoustic sensor, the received information describing the airborne acoustic pressure wave at an entrance of the ear of the user detected by the acoustic sensor;

updating the vibration instructions based in part on the detected acoustic pressure wave; and providing the updated vibration instructions to the transducer assembly.

17. The non-transitory computer-readable storage medium of claim 16, wherein the vibration instructions include a content signal based on the audio content for presentation to the user, a control signal to enable or disable the transducer assembly, and a gain signal to amplify the content signal.

18. The non-transitory computer-readable storage medium of claim 16, the instructions executable to perform steps further comprising:

adjusting a frequency response model based in part on a detected airborne acoustic pressure wave at an entrance of the ear of the user;

updating the vibration instructions using the adjusted frequency response model; and providing the updated vibration instructions to the transducer assembly.

19. The non-transitory computer-readable storage medium of claim 18, wherein adjusting the frequency response model further comprises:

computing an inverse function; and applying the inverse function to the detected airborne acoustic pressure wave.

20. The non-transitory computer-readable storage medium of claim 18, wherein a flat spectrum broadband signal is used to generate the adjusted frequency response model.

* * * * *